US010556733B2

(12) United States Patent
Takeuchi

(10) Patent No.: US 10,556,733 B2
(45) Date of Patent: Feb. 11, 2020

(54) BUFFER MATERIAL

(71) Applicant: KYOCERA Document Solutions Inc., Osaka (JP)

(72) Inventor: Masakazu Takeuchi, Osaka (JP)

(73) Assignee: KYOCERA DOCUMENT SOLUTIONS INC., Osaka (JP)

( * ) Notice: Subject to any disclaimer, the term of this patent is extended or adjusted under 35 U.S.C. 154(b) by 44 days.

(21) Appl. No.: 15/920,627

(22) Filed: Mar. 14, 2018

(65) Prior Publication Data

US 2018/0273273 A1 Sep. 27, 2018

(30) Foreign Application Priority Data

Mar. 21, 2017 (JP) ..... 2017-055002

(51) Int. Cl.
*B65D 5/50* (2006.01)
*B65D 81/133* (2006.01)

(52) U.S. Cl.
CPC ..... *B65D 81/133* (2013.01); *B65D 5/505* (2013.01); *B65D 2581/053* (2013.01)

(58) Field of Classification Search
CPC ..... B65D 5/50; B65D 5/505; B65D 81/02; B65D 81/113; B65D 81/133; B65D 2581/053
USPC ..... 206/521, 588, 591, 592
See application file for complete search history.

(56) References Cited

U.S. PATENT DOCUMENTS 2,995,288 A * 8/1961 Jesinghaus ..... B65D 5/5045 206/594
5,322,168 A * 6/1994 Kataoka ..... B65D 5/5035 206/583
5,467,875 A * 11/1995 Sato ..... B65D 5/5069 206/588
5,979,659 A * 11/1999 Kataoka ..... B65D 5/5071 206/320

FOREIGN PATENT DOCUMENTS

JP 3722872 A * 11/2005 ..... B65D 5/50
JP 3773609 A * 5/2006 ..... B65D 81/113
JP 4030345 A * 1/2008 ..... B65D 81/113
JP 2013-199291 10/2013

* cited by examiner

*Primary Examiner* — Bryon P Gehman
(74) *Attorney, Agent, or Firm* — Wenderoth, Lind & Ponack, L.L.P.

(57) ABSTRACT

A buffer material includes a pair of impact absorption parts. Each of the pair of impact absorption parts has a first rectangular plate part, which is formed by cutting a predetermined place of the sheet material and is bendable downward along one end edge, and a second rectangular plate part which is concatenated to the other end edge of the first rectangular plate part and has a length in a direction along the other end edge, which is longer than a length in the direction of the first rectangular plate part. Each of the pair of impact absorption parts is formed by bending the first rectangular plate part in a sectional V shape and allowing both end portions of the second rectangular plate part in the direction along the other end edge to be engaged with and held to an upper surface of the support plate part.

4 Claims, 11 Drawing Sheets

BUFFER MATERIAL

CROSS-REFERENCE TO RELATED APPLICATION

This application is based upon and claims the benefit of priority from Japanese Patent Application No. 2017-055002 filed on Mar. 21, 2017, the entire contents of which are incorporated herein by reference.

BACKGROUND

The technology of the present disclosure relates to a buffer material formed by bending a sheet material.

In the related art, there has been known a buffer material, which uses a sheet material of a corrugated cardboard and the like, as a buffer material for protecting a product from an impact at the time of transportation or handling. As an example of the buffer material, there has been proposed a buffer material in which a corrugated cardboard is bent in a quadrangular tubular shape and cuneiform notches are formed at both end portions of the corrugated cardboard.

In the aforementioned proposed buffer material, in addition to a case where a product is directly placed on an upper surface of the buffer material, there is a case where for example, a buffer material 100 is assembled, to a product placing member 200 as illustrated in FIG. 9. As illustrated in FIG. 10, the product placing member 200 has a placing plate 201 on which a product is placed, a pair of side walls 202 that stand up from both end edges in a width direction of the placing plate 201, and side protection parts 203 that are provided to center parts in a longitudinal direction of the side walls 202 and protect sides of the product. A reference numeral 300 of the drawing indicates an upper protection member 300 that protects an upper side of the product.

As illustrated in FIG. 8 and FIG. 11, the buffer material 100 has an insertion plate 101 that is inserted into a slit hole formed in the aforementioned placing plate 201, and an impact absorption part 102 that is concatenated to the insertion plate 101 and is bent in a quadrangular tubular shape. The impact absorption part 102 is formed on the upper surface thereof with a notch hole 104, and an engagement piece 105 formed by cutting and raising a part of the insertion plate 101 is engaged with the notch hole 104.

SUMMARY

A buffer material according to one aspect of the present disclosure is formed by bending a sheet material. The buffer material is mounted at a product placing member having a placing plate on which a product is placed.

The aforementioned placing plate is formed with a pair of slit holes arranged while being spaced apart from each other. The buffer material includes a support plate part, a pair of insertion plate parts, and a pair of impact absorption parts. The support plate part supports the placing plate from below. The pair of insertion plate parts are concatenated to a pair of facing sides facing each other in the support plate part and are bent upward to be inserted into the aforementioned pair of slit holes. The impact absorption parts support a lower side of the support plate part from below and absorb an impact.

Each of the aforementioned pair of impact absorption parts has a first rectangular plate part and a second rectangular plate part. The first rectangular plate part is formed by cutting a predetermined place of the aforementioned sheet material. The first rectangular plate part is bendable downward along one end edge. The second rectangular plate part is concatenated to the other end edge of the first rectangular plate part. The second rectangular plate part has a length in a direction along the other end edge, which is longer than a length in the direction of the first rectangular plate part. Each of the pair of impact absorption parts is formed by bending the first rectangular plate part in a sectional V shape convex downward and allowing both end portions of the aforementioned second rectangular plate part in the direction along the aforementioned other end edge to be engaged with and held to an upper surface of the aforementioned support plate part.

DETAILED DESCRIPTION

Hereinafter, an example of an embodiment will be described in detail on the basis of the drawings. It is noted that the technology of the present disclosure is not limited to the following embodiment.

Figure 1:
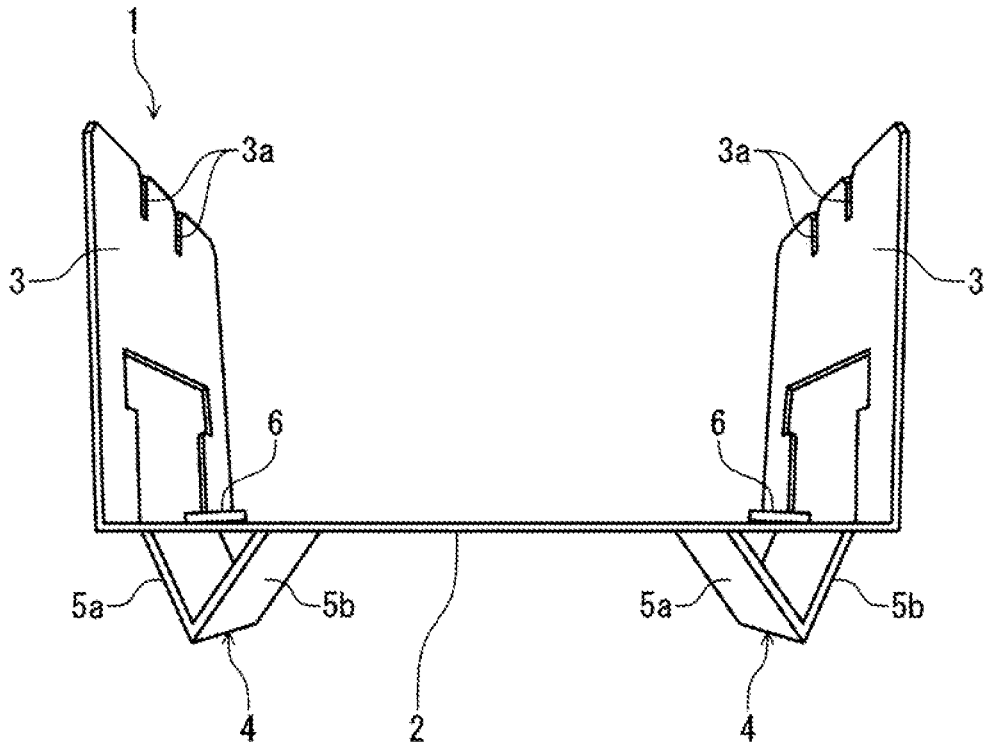
FIG. 1 is a perspective view when a buffer material according to an embodiment is viewed from a side.
Figure 2:
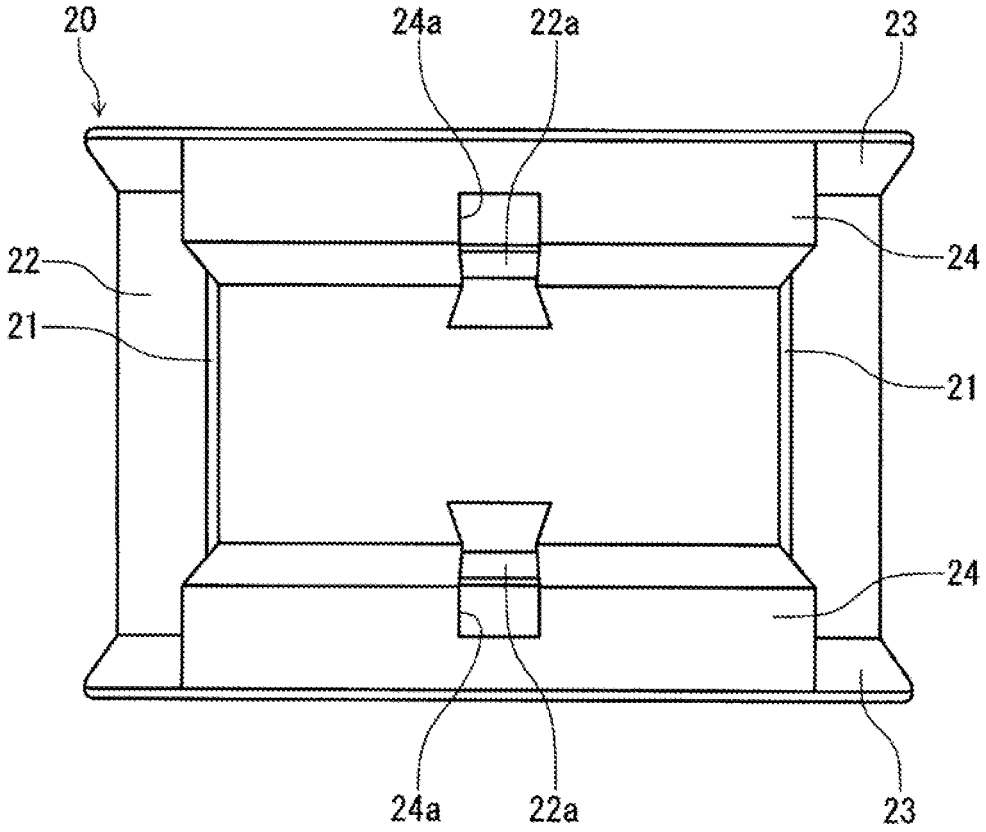
FIG. 2 is a view when a product placing member assembled with a buffer material according to an embodiment is viewed from above.
Figure 3:
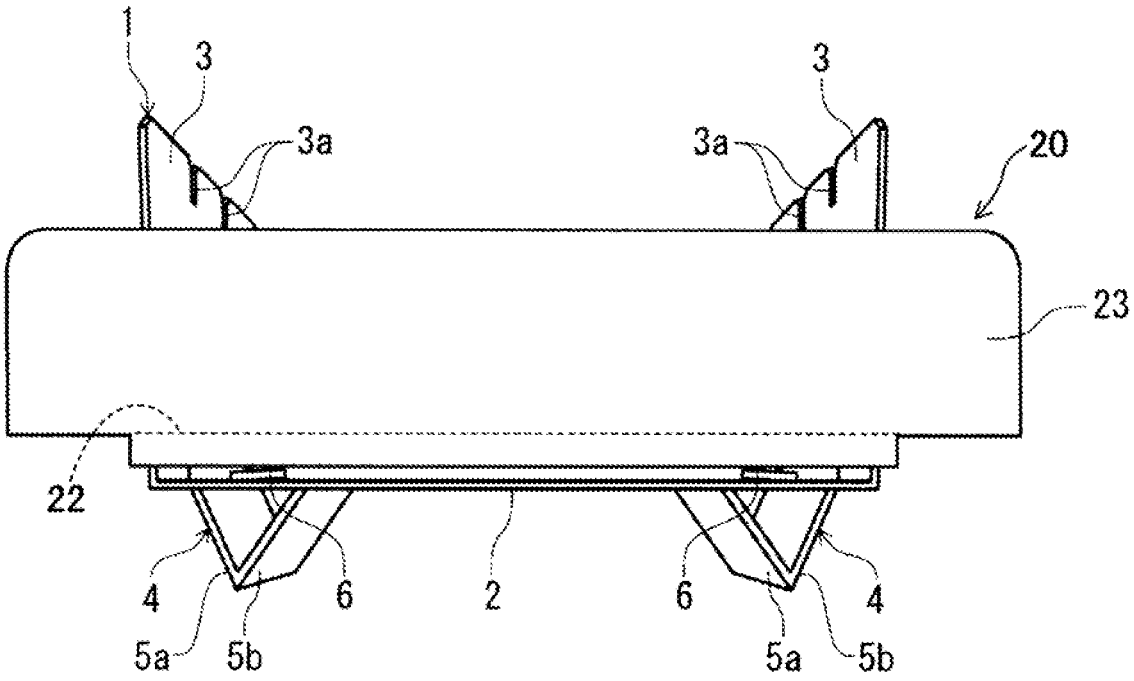
FIG. 3 is a perspective view when a state, in which a buffer material according to an embodiment has been assembled to a product placing member, is viewed from a side.

FIG. 1 illustrates a suffer material 1 according to an embodiment. The buffer material 1 is assembled to a product placing member 20 illustrated in FIG. 2. The buffer material 1 is assembled to the product placing member 20 from below as illustrated in FIG. 3. The buffer material 1 protects a product from an impact at the time of transportation or handling of the product. Details of the buffer material 1 will be described later.

The product placing member 20 is formed by bending a sheet material of a corrugated cardboard and the like. As illustrated in FIG. 2, the product placing member 20 has a rectangular placing plate 22 on which a product (not illustrated, for example, a flat hard disk in the present embodiment) is placed. The placing plate 22 is formed with a pair of slit holes 21 arranged in parallel to each other while being spaced apart from each other in a longitudinal direction. Side plates 23 stand up from a pair of end edges of the placing plate 22, which extend in the longitudinal direction. A rectangular tubular side protection part 24 is concatenated to a center part in the longitudinal direction of each side plate 23. The side protection part 24 is formed at the center part in the longitudinal direction thereof with a notch hole 24*a*, wherein an engagement piece 22*a* formed by cutting and raising a part of the placing plate 22 is engaged with the notch hole 24*a*. A product is placed on an area surrounded by the pair of slit boles 21 and the pair of side protection parts 24 in the placing plate 22. Insertion plate parts 3 provided to the buffer material 1 are inserted into the pair of slit holes 21, respectively.

As illustrated in FIG. 3, at an upper end portions of each insertion plate part 3 of the buffer material 1, a pair of engagement grooves 3*a* extending in an up and down direction are formed while being spaced apart, from each other in a width direction. An upper protection member 30 (see FIG. 4) is engaged with and assembled to each engagement groove 3*a*. The upper protection member 30 is formed by bending a sheet material of a corrugated cardboard and the like.

Figure 4:
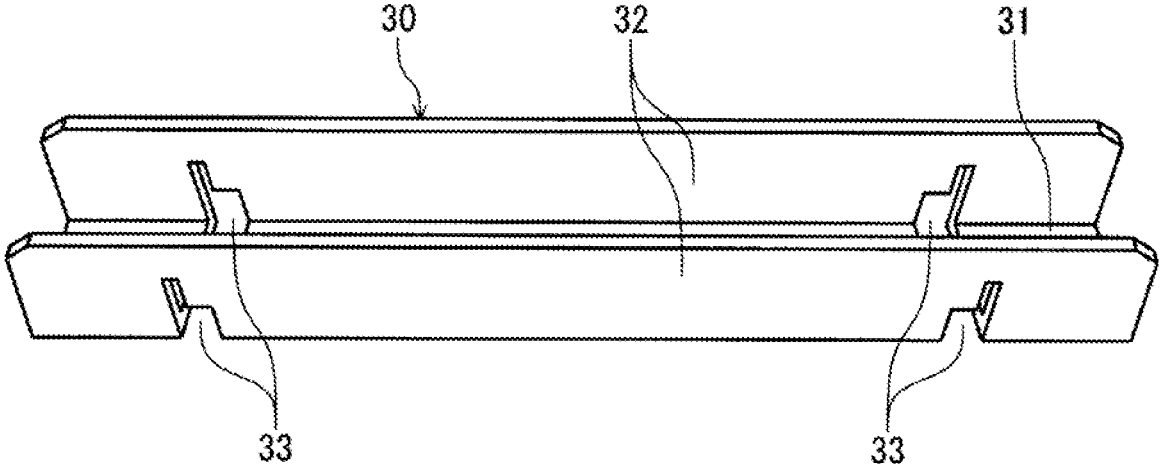
FIG. 4 is a perspective view illustrating an upper protection member.

As illustrated in FIG. 4, the upper protection member 30 includes a columnar body which is opened upward and has a channel-shaped (U-shaped) section. Specifically, the upper protection member 30 has a base plate 31 extending in a direction equal to the longitudinal direction of the placing plate 22, and a pair of side plates 32 standing up from a pair of end edges of the base plate 31, which extend in the longitudinal direction. The upper protection member 30 is formed at both end portions in the longitudinal direction thereof with engagement grooves 33 having an approximately L shape when viewed from a side. Furthermore, parts of the side plates 32 of the upper protection member 30, which correspond to the engagement grooves 33, are configured to be engaged with the engagement grooves 3*a* of the buffer material 1.

Figure 5:
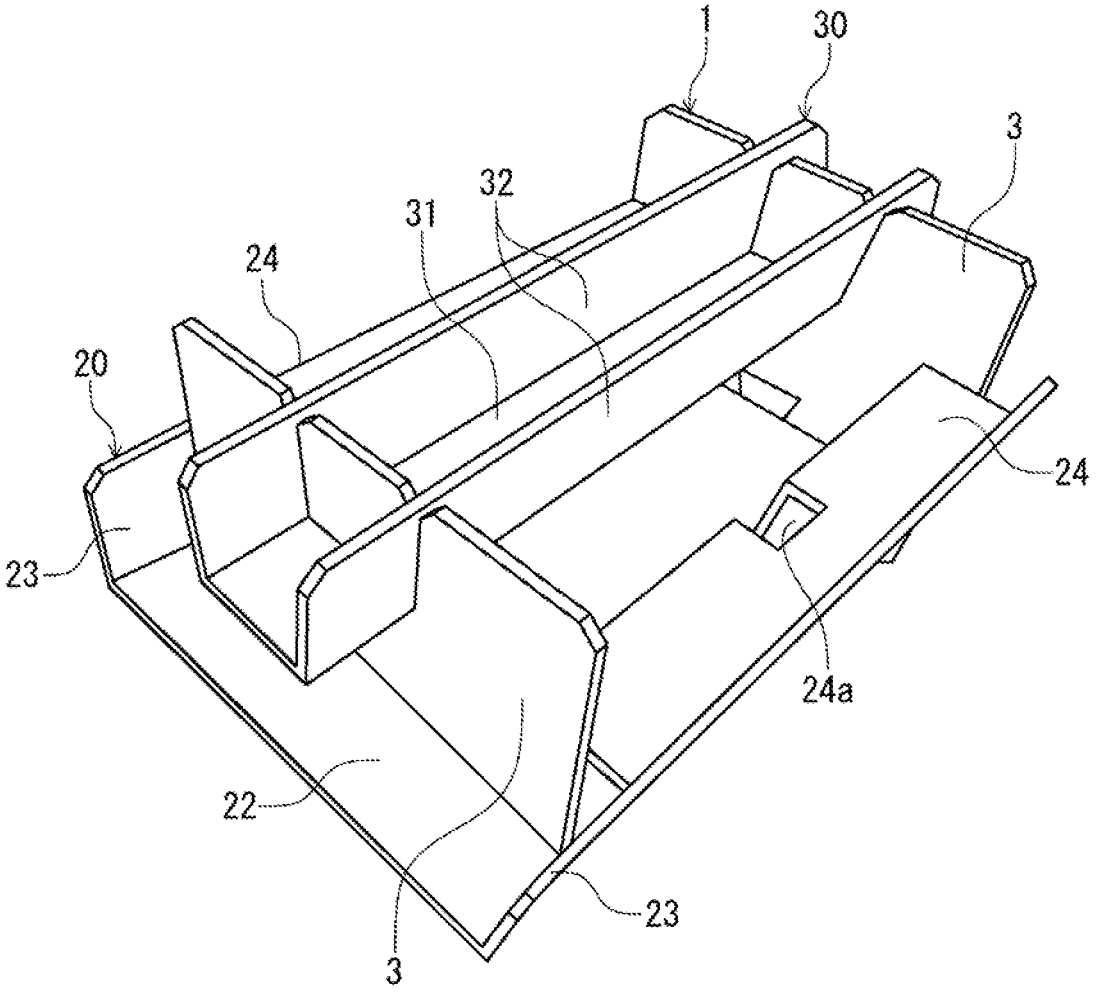
FIG. 5 is a perspective view illustrating a state in which an upper protection member has been assembled to a product placing member.

FIG. 5 is a perspective view illustrating a state in which the upper protection member 30 has been assembled to the upper end portions of the pair of insertion plate parts 3 in the buffer material 1. A product placed on the placing plate 22 is protected from an upper side by the upper protection member 30. An impact at the time of falling and the like of the product is reduced by the aforementioned the buffer material 1.

Figure 6:
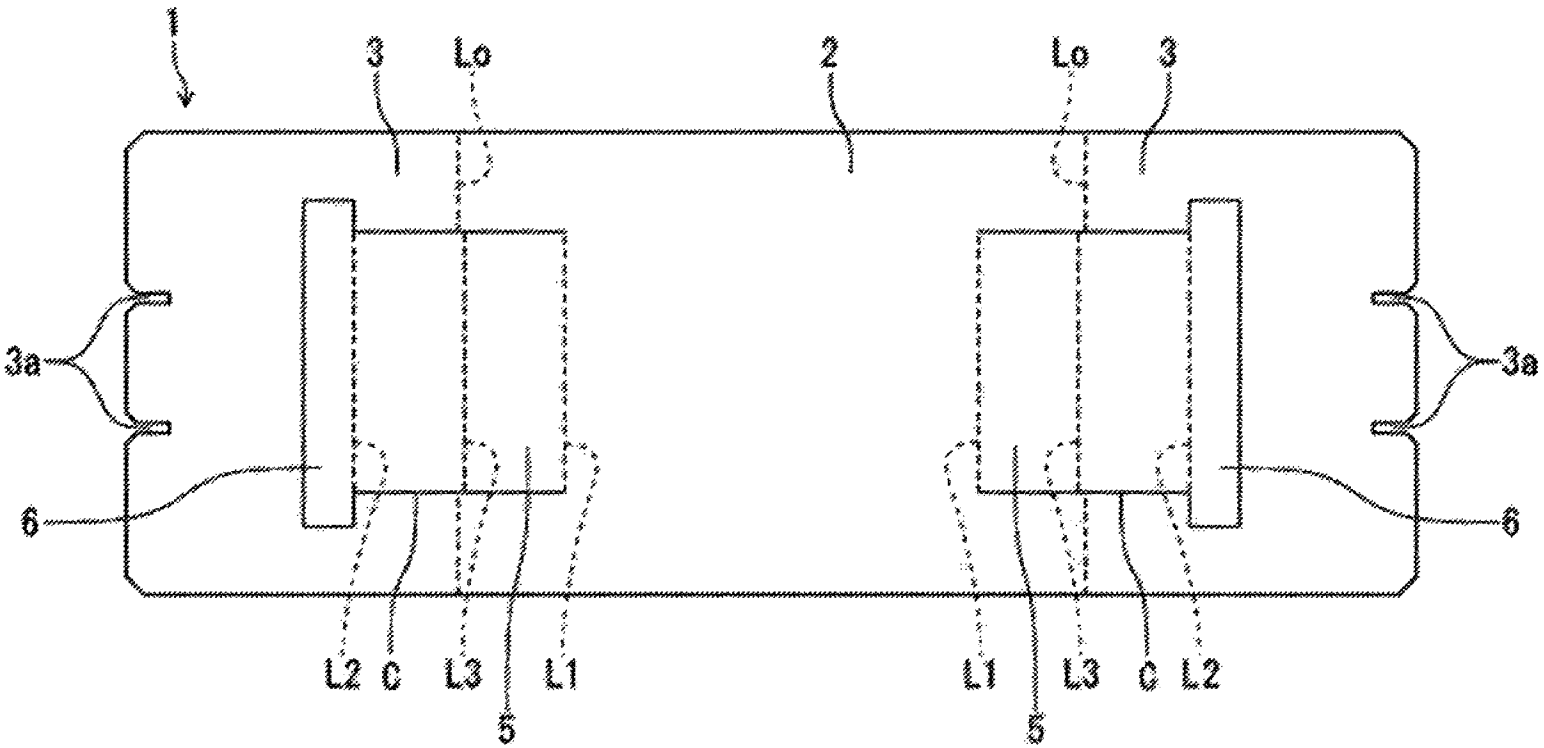
FIG. 6 is a development view of a buffer material according to an embodiment.

FIG. 6 is a development view of the buffer material 1. As illustrated in FIG. 6, the buffer material 1 is formed by bending a rectangular sheet material long in a predetermined direction in a plan view. The buffer material 1 has a support plate part 2, the pair of insertion plate parts 3, a first rectangular plate part 5 bent to form an impact absorption part 4 (see FIG. 1 and FIG. 3), and a second rectangular plate part 6 concatenated to the first rectangular plate part 5.

The support plate part 2 is a part that supports the placing plate 22 of the product placing member 20 from below and forms a rectangular plate shape long in a predetermined direction. The pair of insertion plate parts 3 form a rectangular plate shape having the same width as that of the support plate part 2. The insertion plate parts 3 are respectively concatenated to a pair of end edges facing each other in the longitudinal direction of the support plate part 2 via bending lines L0.

The first rectangular plate part 5 is formed across a base end portion of the insertion plate part 3 from an end portion in the longitudinal direction of the support plate part 2. The first rectangular plate part 5 can be bent along a bending line L1 formed at its base end edge (an end edge of the support plate part 2 side). To a distal end edge of the first rectangular plate part 5 (an end edge of the insertion plate part 3 side), the second rectangular plate part 6 is concatenated, wherein a length of the second rectangular plate part 6 in a direction along the end edge is longer than a length in the direction of the first rectangular plate part 5. At a boundary position between the first rectangular plate part 5 and the second rectangular plate part 6, a bending line L2 is formed. The bending lines L1 and L2 extend in a direction perpendicular to the longitudinal direction of the support plate part 2. In the first rectangular plate part 5, a bending line L3 extending in parallel to the bending lines L1 and L2 is formed between the bending line L1 and the bending line L2. The first rectangular plate part 5 and the second rectangular plate part 6 are surrounded by the aforementioned bending line L1 and a breakable line C. The breakable line C is a cut line in the present embodiment; however, for example, the breakable line C may be configured with a perforated line, a half-cut line and the like.

Figure 7:
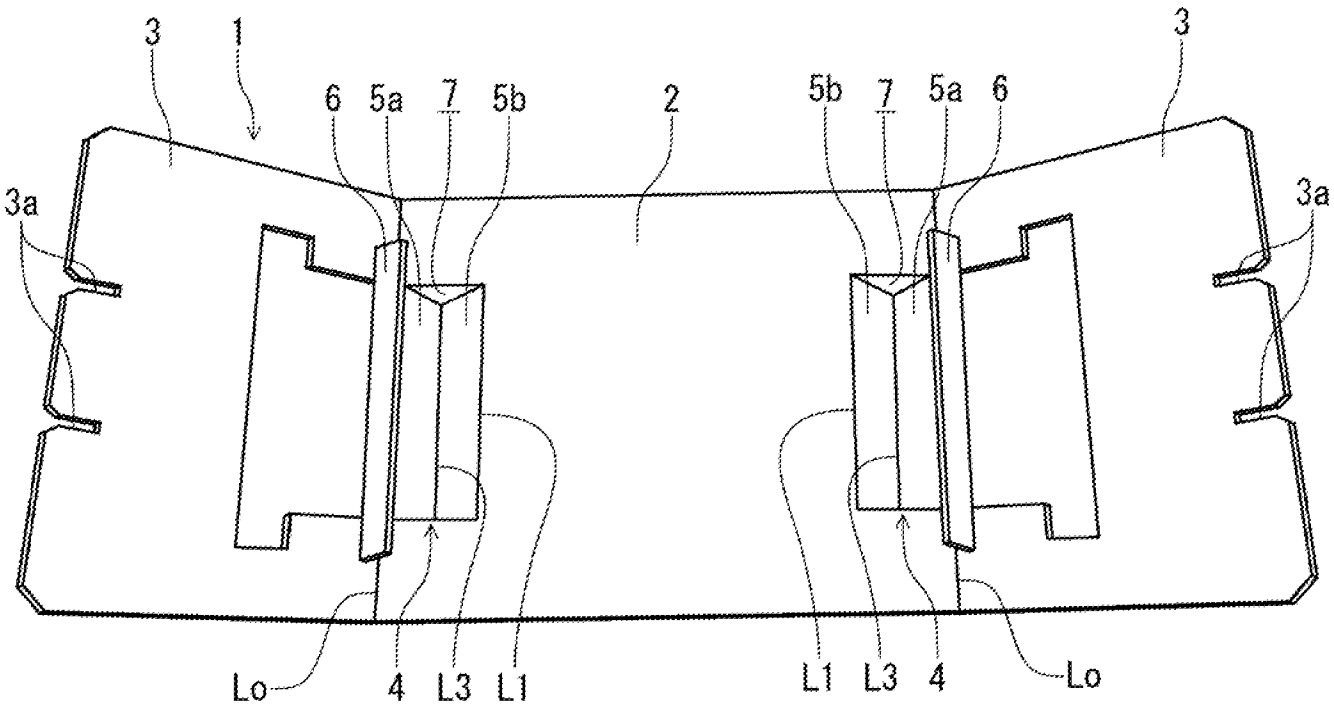
FIG. 7 is a perspective view for explaining an assembly procedure of an impact absorption part in a buffer material according to an embodiment.
Figure 8:
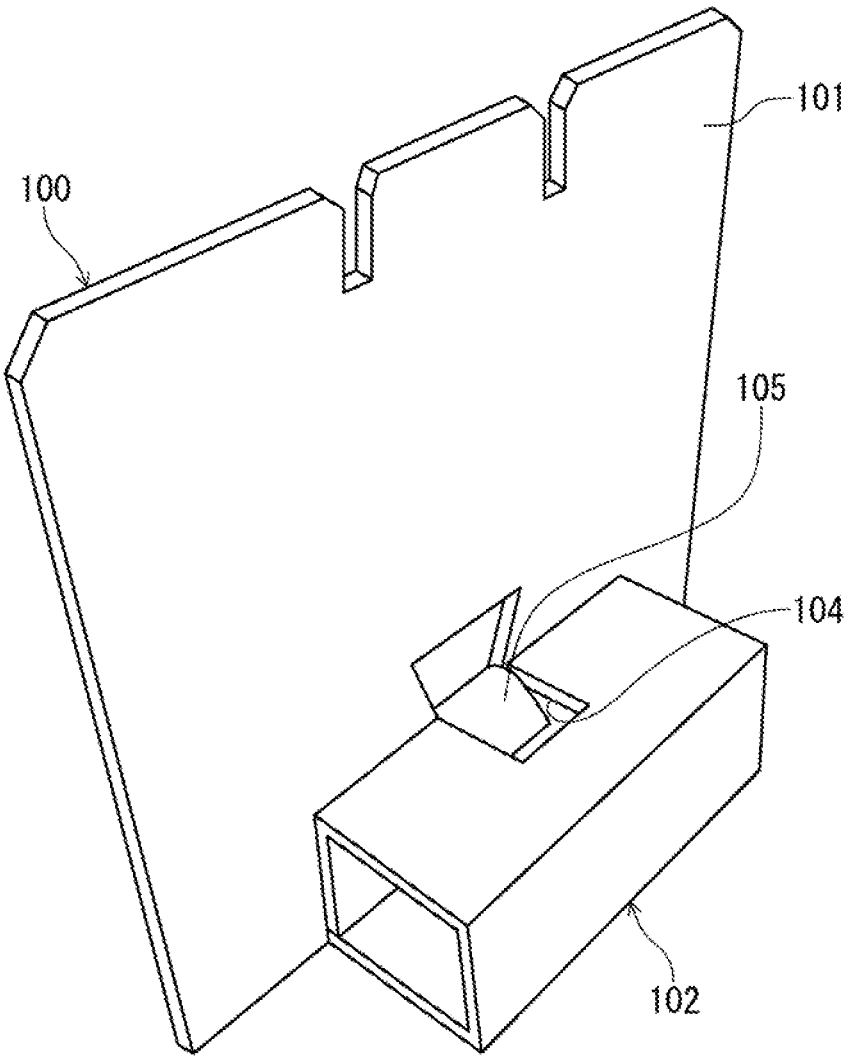
Fig.8 Prior Art
FIG. 8 is a perspective view illustrating a buffer material according to the related art.
Figure 9:
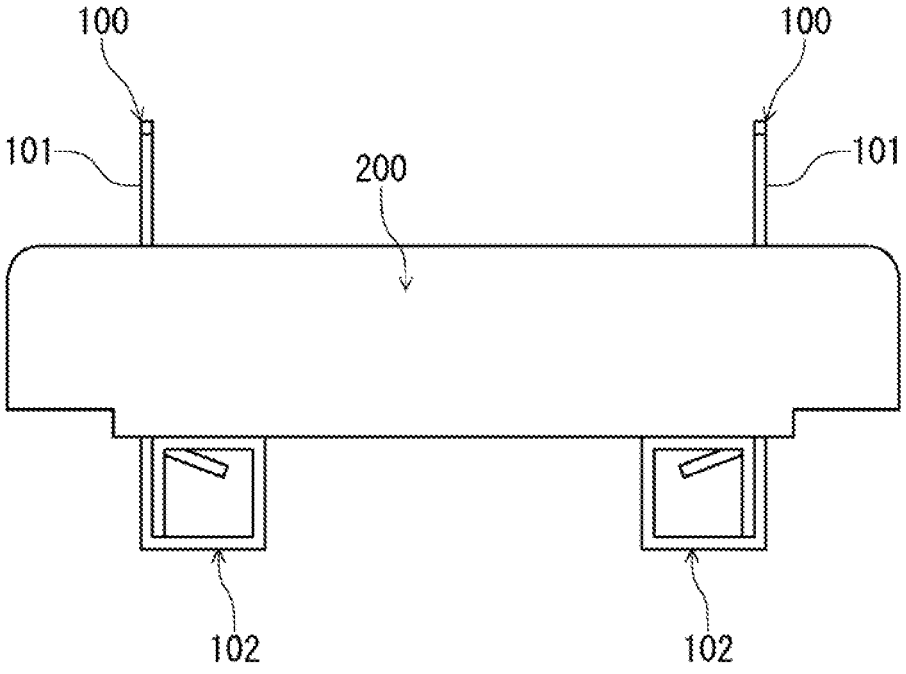
Fig.9 Prior Art
FIG. 9 is a view when a state, in which a buffer material according to the related art has been assembled to a product placing member, is viewed from a side.
Figure 10:
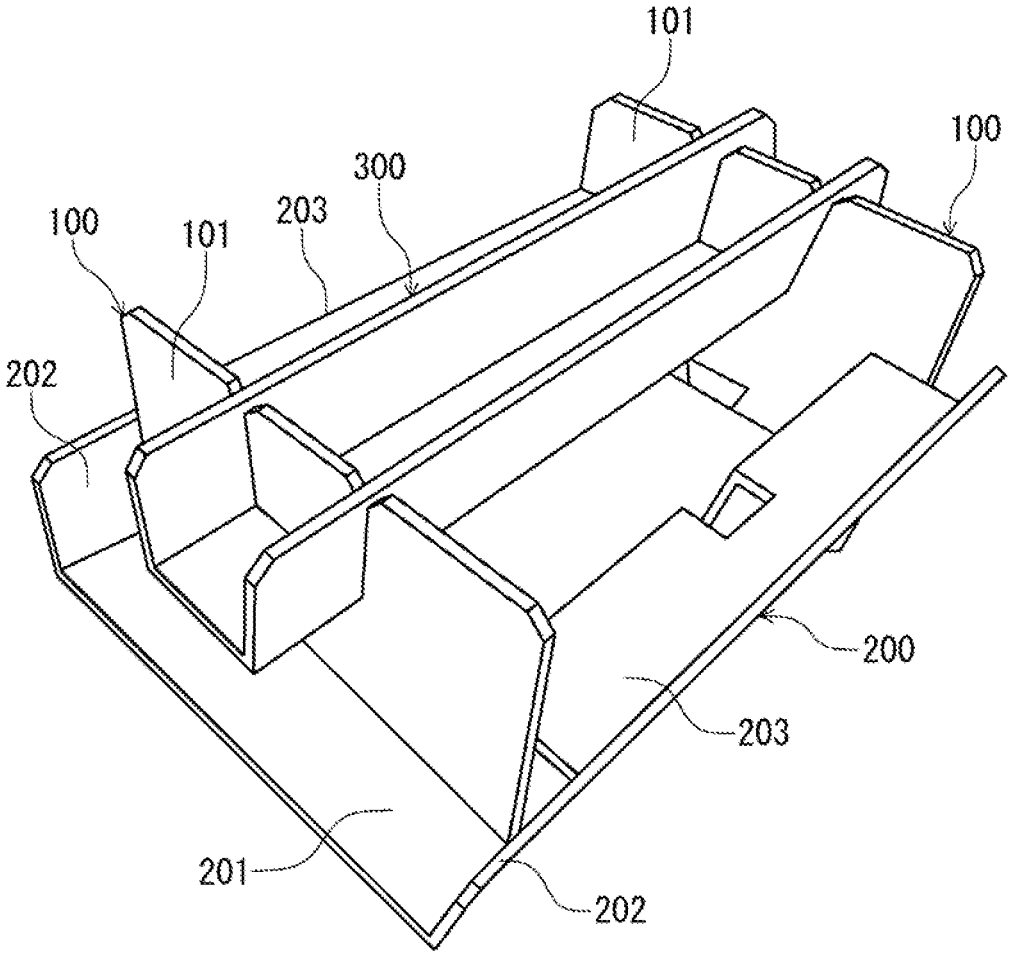
Fig.10 Prior Art
FIG. 10 is a perspective view when a state, in which an upper protection member has been assembled to a product placing member according to the related art, is viewed from an obliquely upper position.
Figure 11:
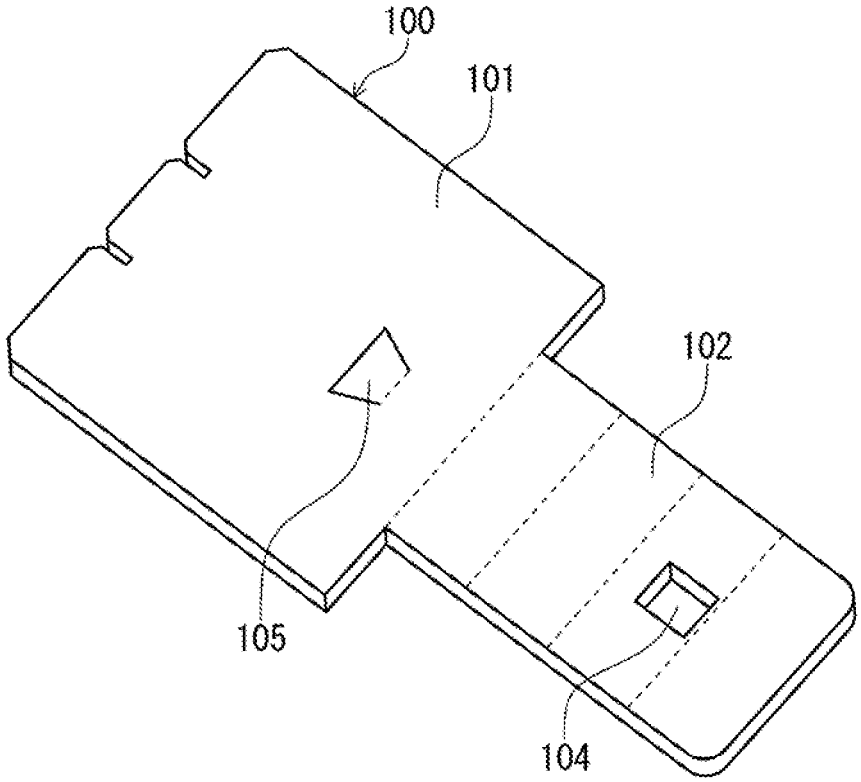
Fig.11 Prior Art
FIG. 11 is a development view of a buffer material according to the related art.

As illustrated in FIG. 7, when the buffer material 1 is assembled, the first rectangular plate part 5 is bent along the bending lines L1 and L3 to form a sectional V shape (a sectional V shape convex downward) including an inclined plane 5*a* an inclined plane 5*b*. In this state, the support plate part 2 is formed with rectangular openings 7 extending along the bending line L1 when the first rectangular plate part 5 is bent. Next, the second rectangular plate part 6 is bent along the bending line L2, so that its both end portions are engaged with and held to (abut) the vicinity of both end portions of the aforementioned opening 7 on the upper surface of the support plate part 2. In this way, the impact absorption part 4 (see FIG. 1) having an approximately triangular tubular shape is completed. Furthermore, in this state, the pair of insertion plate parts 3 are bent with respect to the support plate part 2 at a right angle, and are inserted into the slit holes 21 of the product placing member 20. By so doing, as illustrated in FIG. 3, the second rectangular plate part 6 is interposed between the placing plate 22, on which a product is placed, and the support plate part 2 of the buffer material 1 and enters a semi-stationary state. In this way, the shape of the impact absorption part 4 is maintained in a triangular tubular shape. In this state, when a product is placed on the upper surface of the placing plate 22, since a weight of the product acts on the upper surface of the second rectangular plate part 6, the shape stability of the impact absorption part 4 is further improved.

When the impact absorption part is formed in a quadrangular tubular shape as with the conventional buffer material, the shape stability of the impact absorption part is excessively high, resulting in a lack of a deformation amount of the impact absorption part when an impact is applied. Therefore, there is a problem that it is difficult to obtain a buffer effect due to deformation of the impact absorption part. In order to solve this problem, it is considered to form the impact absorption part in a triangular tubular shape as with the present embodiment so as to improve its deformation properties. However, in this case, the shape stability of the impact absorption part is deteriorated, resulting in an excessive increase in a deformation amount when an impact is applied. As a consequence, the impact absorption part is completely crushed when absorbing the impact, resulting in a problem that it is not possible to obtain a buffer effect.

In this regard, in the present embodiment, as described above, a weight of a product acts on the upper surface of the second rectangular plate part 6 via the placing plate 22 (see FIG. 3). In this way, it is possible to enhance the shape stability of the impact absorption part 4 as much as possible while forming the impact absorption part 4 in a triangular tubular shape having high deformation properties. At the time of falling of a product (the product placing member 2), impact load acts on the second rectangular plate part 6, so that it is possible to moderately deform the impact absorption part 4 while keeping the shape stability of the impact absorption part 4. Thus, both compatibility between the deformation properties and the shape stability of the impact absorption part 4 are established, so that it is possible to improve the buffer capability of the buffer material 1 as much as possible.

Moreover, in the present embodiment, both end portions of the second rectangular plate part 6 are engaged with and held to the outside of both end portions of the opening 7 on the upper surface of the support plate part 2. The opening 7 is an opening formed by bending the first rectangular plate part 5 along the bending line L1. Consequently, as compared with a case of providing a dedicated opening for allowing both end portions of the second rectangular plate part 6 to be engaged with and held to the upper surface of the support plate part 2, the structure of the buffer material 1 is simplified, so that it is possible to facilitate an assembly work of the buffer material 1.

As described above, the present invention is useful for a buffer material formed by bending a sheet material.

What is claimed is:

1. A buffer material, which is mounted at a product placing member having a placing plate on which a product is placed and is formed by bending a sheet material, wherein the placing plate is formed with a pair of slit holes arranged while being spaced apart from each other, and the buffer material comprises:

a support plate part that supports the placing plate from below;

a pair of insertion plate parts that are concatenated to a pair of facing sides facing each other in the support plate part and are bent upward along each of the facing sides to be inserted into the pair of slit holes; and a pair of impact absorption parts that support a lower side of the support plate part from below and absorb an impact, wherein each of the pair of impact absorption parts has a first rectangular plate part, which is formed by cutting a predetermined place of the sheet material and is bendable downward along one end edge, and a second rectangular plate part, which is concatenated to an other end edge of the first rectangular plate part, the other end edge being parallel to the one end edge, and the second rectangular plate part being longer than the first rectangular plate part in a plate width direction, which is parallel to the other end edge, and wherein each of the pair of impact absorption parts is formed by bending the first rectangular plate part downward along the one end edge and bending upward at a middle position between the one end edge and the other end edge to form a sectional V shape convex downward with respect to the support plate part, and further by allowing both end portions of the second rectangular plate part in the plate width direction to be engaged with and held to an upper surface of the support plate part.

2. The buffer material of claim 1, wherein, for each of the pair of impact absorption parts, the support plate part is formed with an opening extending along the one end edge, which is formed by bending the first rectangular plate part along the one end edge, and the end portions of the second rectangular plate part in the plate width direction are engaged with and held to portions of the upper surface of the support plate part on opposite sides of the opening in the plate width direction.

3. The buffer material of claim 1, wherein for each of the pair of impact absorption parts, a first bending line is provided at a place corresponding to the one end edge, and a second bending line is provided at a place corresponding to the middle position, the pair of facing sides are arranged in parallel to each other, the first bending lines and the second bending lines are arranged in parallel to the pair of facing sides, and each of the pair of impact absorption parts is formed by bending the first rectangular plate part downward along the first bending line, and bending the first rectangular plate part upward along the second bending line at the middle position between the one end edge and the other end edge to form the sectional V shape convex downward with respect to the support plate part, and further by allowing both of the end portions of the second rectangular plate part in the plate width direction to be engaged with and held to the upper surface of the support plate part.

4. The buffer material of claim 3, wherein for each of the pair of impact absorption parts, a third bending line is formed at a boundary position between the first rectangular plate part and the second rectangular plate part, and the second rectangular plate part of each of the pair of impact absorbing parts is engaged with and held to the upper surface of the support plate part by being bent horizontally along the third bending line.

* * * * *